US007316549B2

(12) United States Patent
Kim et al.

(10) Patent No.: US 7,316,549 B2
(45) Date of Patent: Jan. 8, 2008

(54) STEP-TYPE CAPACITY VARYING APPARATUS OF SCROLL COMPRESSOR

(75) Inventors: Myung-Kyun Kim, Gyeonggi-Do (KR); Byeong-Chul Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 55 days.

(21) Appl. No.: 11/167,150

(22) Filed: Jun. 28, 2005

(65) Prior Publication Data

US 2006/0177332 A1 Aug. 10, 2006

(30) Foreign Application Priority Data

Feb. 4, 2005 (KR) ..... 10-2005-0010805

(51) Int. Cl.
*F03C 2/00* (2006.01)
*F04C 18/00* (2006.01)

(52) U.S. Cl. ..... 418/55.2; 418/55.1; 417/310

(58) Field of Classification Search ..... 418/55.1, 418/55.2; 417/213, 217, 310
See application file for complete search history.

(56) References Cited

U.S. PATENT DOCUMENTS 4,477,238 A * 10/1984 Terauchi ..... 418/55.1
6,585,501 B2 * 7/2003 Takeuchi et al. ..... 418/55.2

FOREIGN PATENT DOCUMENTS

JP 04311693 A * 11/1992 ..... 418/55.2
JP 05071477 A * 3/1993 ..... 418/55.2
JP 05288169 A * 11/1993 ..... 418/55.2
JP 2000-329079 11/2000

OTHER PUBLICATIONS

English Language Abstract of JP 2000-329079.

* cited by examiner

*Primary Examiner*—Theresa Trieu
(74) *Attorney, Agent, or Firm*—Greenblum & Bernstein, P.L.C.

(57) ABSTRACT

Disclosed is a step-type capacity varying apparatus of a scroll compressor comprising: an orbiting scroll having a first filling portion step-formed with a constant height from an outer end portion of a wrap towards an inner side of the wrap, and a second filling portion extendingly formed at the first filling portion with a certain length from the outer end of the wrap; a fixed scroll engaged with the orbiting scroll by being provided with a stepped low wrap corresponding to the first filling portion and the second filling portion of the orbiting scroll; and an opening/closing unit for opening and closing a passage formed by the second filling portion of the orbiting scroll and the stepped low wrap of the fixed scroll. According to this, a fabrication cost is lowered, a capacity variation width is greatly increased, and an operation is facilitated.

10 Claims, 8 Drawing Sheets

STEP-TYPE CAPACITY VARYING APPARATUS OF SCROLL COMPRESSOR

BACKGROUND OF THE INVENTION

1. Field of the Invention

The present invention relates to a scroll compressor, and more particularly, to a step-type capacity varying apparatus of a scroll compressor capable of performing an optimum driving in a corresponding condition by increasing a variation width of a compression capacity and capable of simplifying a capacity conversion.

2. Description of the Conventional Art

Generally, a compressor converts electric energy into kinetic energy, and compresses refrigerant gas by the kinetic energy. The compressor is an important component constituting a refrigerating cycle system, and includes a rotary compressor, a scroll compressor, a reciprocal compressor, etc. according to a compression mechanism. The refrigerating cycle system including the compressor is applied to a refrigerator, an air conditioner, a showcase, etc.

In a scroll compressor, a driving force of a driving motor is transmitted to an orbiting scroll and the orbiting scroll performs an orbiting motion in engagement with a fixed scroll, thereby sucking, compressing, and discharging gas. The orbiting scroll and the fixed scroll are respectively provided with a wrap of an involute shape, and a plurality of compression pockets are formed by the wrap of the fixed scroll and the wrap of the orbiting scroll. As the compression pockets move to a discharge hole for discharging gas as the orbiting scroll performs an orbiting motion, each volume of the compression pockets is gradually decreased thereby to compress gas.

Generally, a pair of compression pockets are formed to be symmetrical with each other on the basis of a discharge port. The two compression pockets have the same volume. When the pair of compression pockets move to a discharge hole after sucking gas at a suction side, another pair of compression pockets are formed at the suction side. The above process is repeatedly performed.

In order to increase a compression capacity compressed by the compression pockets, an asymmetrical scroll compressor in which one compression pocket has a larger volume than another compression pocket is being developed.

In the scroll compressor, under a state that an eccentric portion of a rotation shaft coupled to a driving motor is inserted into a boss portion provided at a lower portion of a disc of an orbiting scroll, a rotation force generated from the driving motor is transmitted to the boss portion of the orbiting scroll through the eccentric portion of the rotation shaft. However, when each volume of the compression pockets formed by the wrap of the fixed scroll and the wrap of the orbiting scroll is greatly varied, the orbiting scroll performs an unstable orbiting motion since the compression pockets for compressing gas are positioned with a certain distance from the boss portion and the eccentric portion to which a rotation force of the driving motor is transmitted.

As a structure for increasing a compression capacity of the scroll compressor, as shown in FIGS. 1 and 2, a wrap 12 having a certain height is formed at a disc 11 of the orbiting scroll 10. Also, a filling portion 13 having a certain height is formed at an inner end portion of the wrap 12 to be positioned at the center of the disc 11. The filling portion 13 is formed with a certain height so as to be positioned at the inner side of the wrap 12 from the inner end of the wrap 12 to a part corresponding to 360°. An insertion groove 14 for inserting an eccentric portion 21 of a rotation shaft 20 is formed at a lower surface of the disc 11 of the orbiting scroll, and the insertion groove 14 is formed up to the inner side of the filling portion 13. The eccentric portion 21 of the rotation shaft is inserted into the insertion groove 14. A section surface of the filling portion 13 is formed so that the eccentric portion 21 of the rotation shaft can be inserted thereinto.

Under the structure, since the eccentric portion 21 of the rotation shaft is positioned up to the inner side of the filling portion 13 of the orbiting scroll, the compression pocket P formed by the wrap 31 of the fixed scroll 30 and the wrap 12 of the orbiting scroll is overlapped with the eccentric portion 21 of the rotation shaft to which a rotation force is transmitted. According to this, the orbiting scroll 10 performs a stable orbiting motion in a condition of a large compression ratio. Also, since the filling portion 13 is formed at the center of the orbiting scroll wrap 12, a volume of a discharge side is largely decreased thereby to relatively increase a compression ratio of discharge gas. The above technique is disclosed in the JP 2000-329079.

In case of an air conditioner to which a refrigerating cycle system having a compressor is applied, it is necessary to vary a capacity of the compressor in order to reduce a consumption power of the air conditioner according to a season change.

A mechanism for varying a capacity of the compressor includes a method for controlling an RPM of a driving motor constituting the compressor, a method for bypassing or leaking gas, and a mixing method therebetween.

In the mechanism for controlling an RPM of a driving motor, a high fabrication cost is required even if a capacity variation width is wide and a function is excellent. Also, an additional device for supplying oil at a low RPM is necessary, and a reliability of a frictional part at a high RPM is required.

In the mechanism for bypassing gas, a capacity variation width is narrow and a function is low even if a fabrication cost can be lowered.

SUMMARY OF THE INVENTION

Therefore, an object of the present invention is to provide a step-type capacity varying apparatus of a scroll compressor capable of performing an optimum driving in a corresponding condition by increasing a variation width of a compression capacity for compressing gas and capable of simplifying a capacity conversion.

Another object of the present invention is to provide a step-type capacity varying apparatus of a scroll compressor capable of lowering a fabrication cost.

To achieve these and other advantages and in accordance with the purpose of the present invention, as embodied and broadly described herein, there is provided a step-type capacity varying apparatus of a scroll compressor comprising: an orbiting scroll having a first filling portion step-formed with a constant height from an outer end portion of a wrap to an inner side of the wrap, and a second filling portion extendingly formed at the first filling portion with a certain length from the outer end of the wrap; a fixed scroll engaged with the orbiting scroll by being provided with a low wrap formed as a region corresponding to the first filling portion and the second filling portion of the orbiting scroll is stepped; and an opening/closing unit for opening and closing a passage formed by the second filling portion of the orbiting scroll and the stepped low wrap of the fixed scroll.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a step-type capacity varying apparatus of a scroll compressor according to the present invention will be explained with reference to the attached drawings in more detail.

Figure 1:
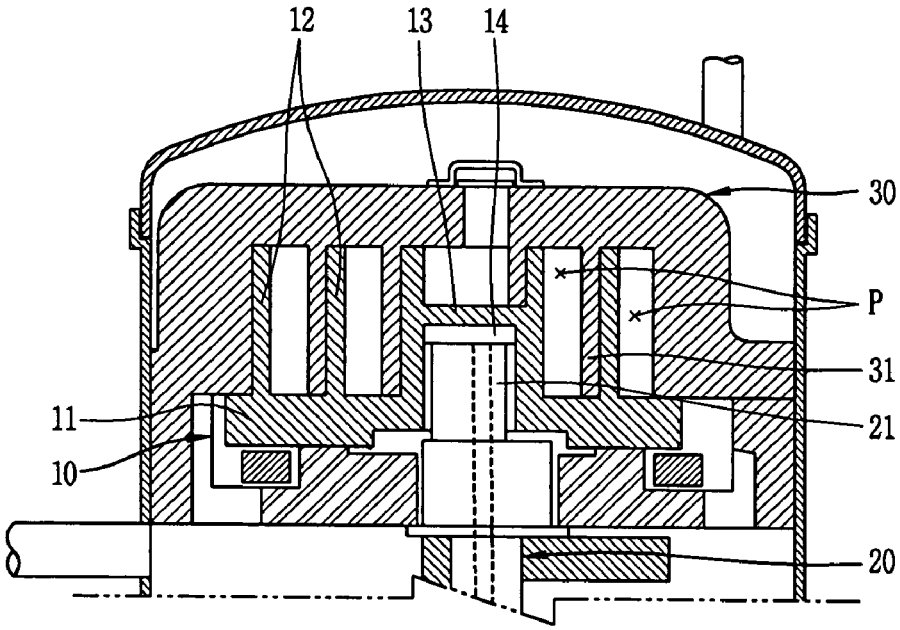
FIG. 1 CONVENTIONAL ART
FIG. 1 is a sectional view showing a compression part of a scroll compressor in accordance with the conventional art.
Figure 2:
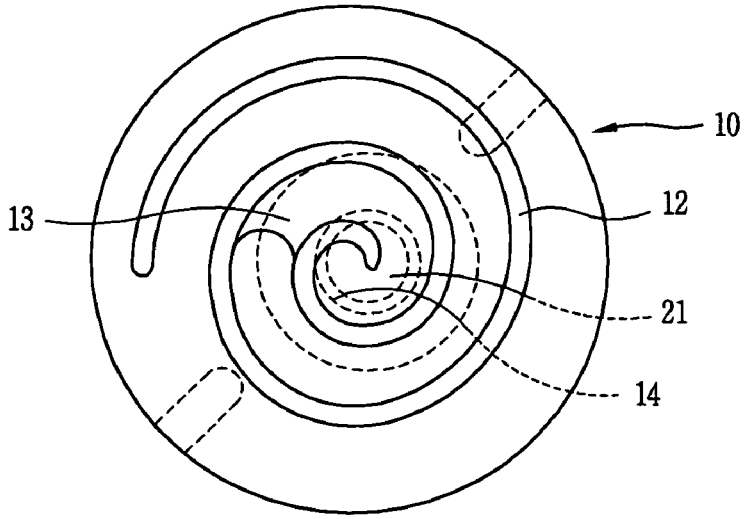
FIG. 2 CONVENTIONAL ART
FIG. 2 is a plane view showing an orbiting scroll constituting the compression part of the scroll compressor in accordance with the conventional art.
Figure 3:
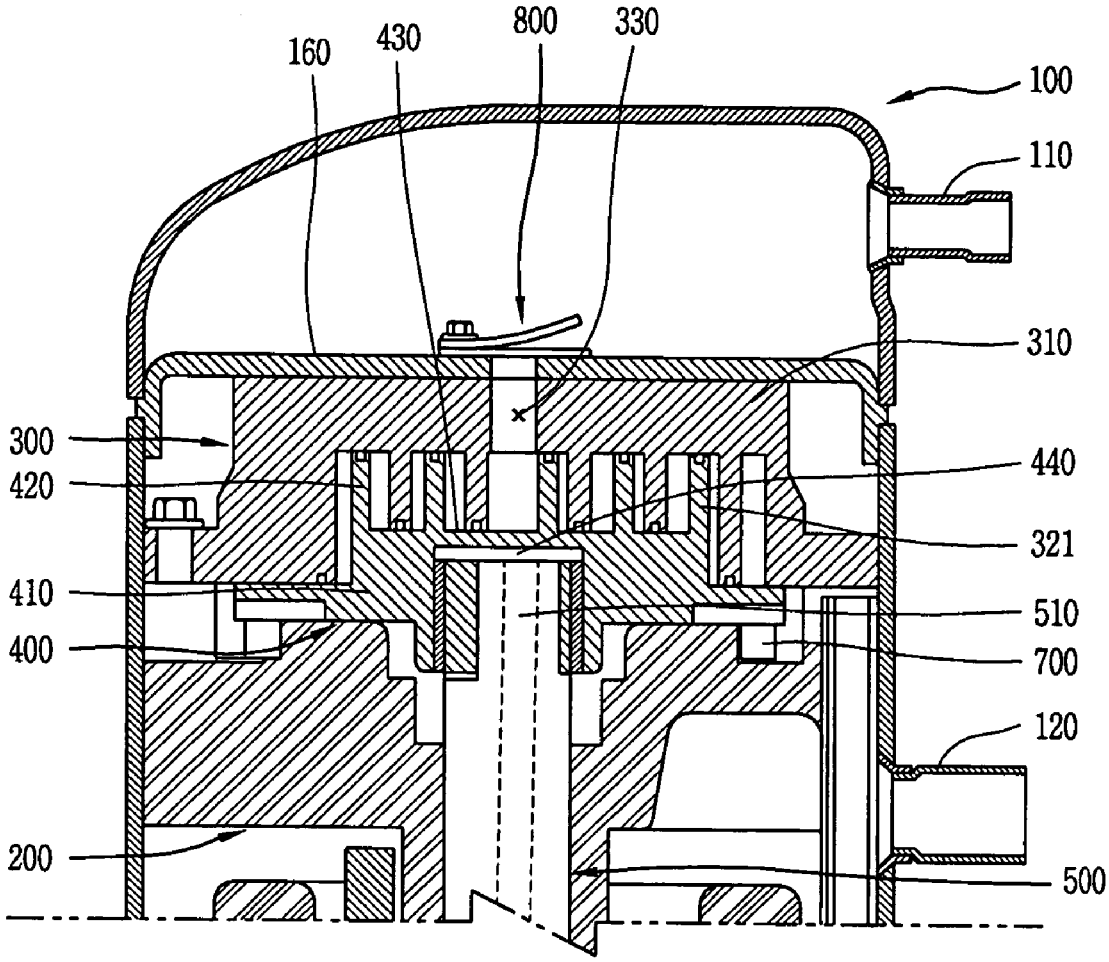
FIGS. 3 and 4 are respectively a frontal section view and a disassembled perspective view showing a compression part of a scroll compressor having a step-type capacity varying apparatus according to the present invention.
Figure 4:
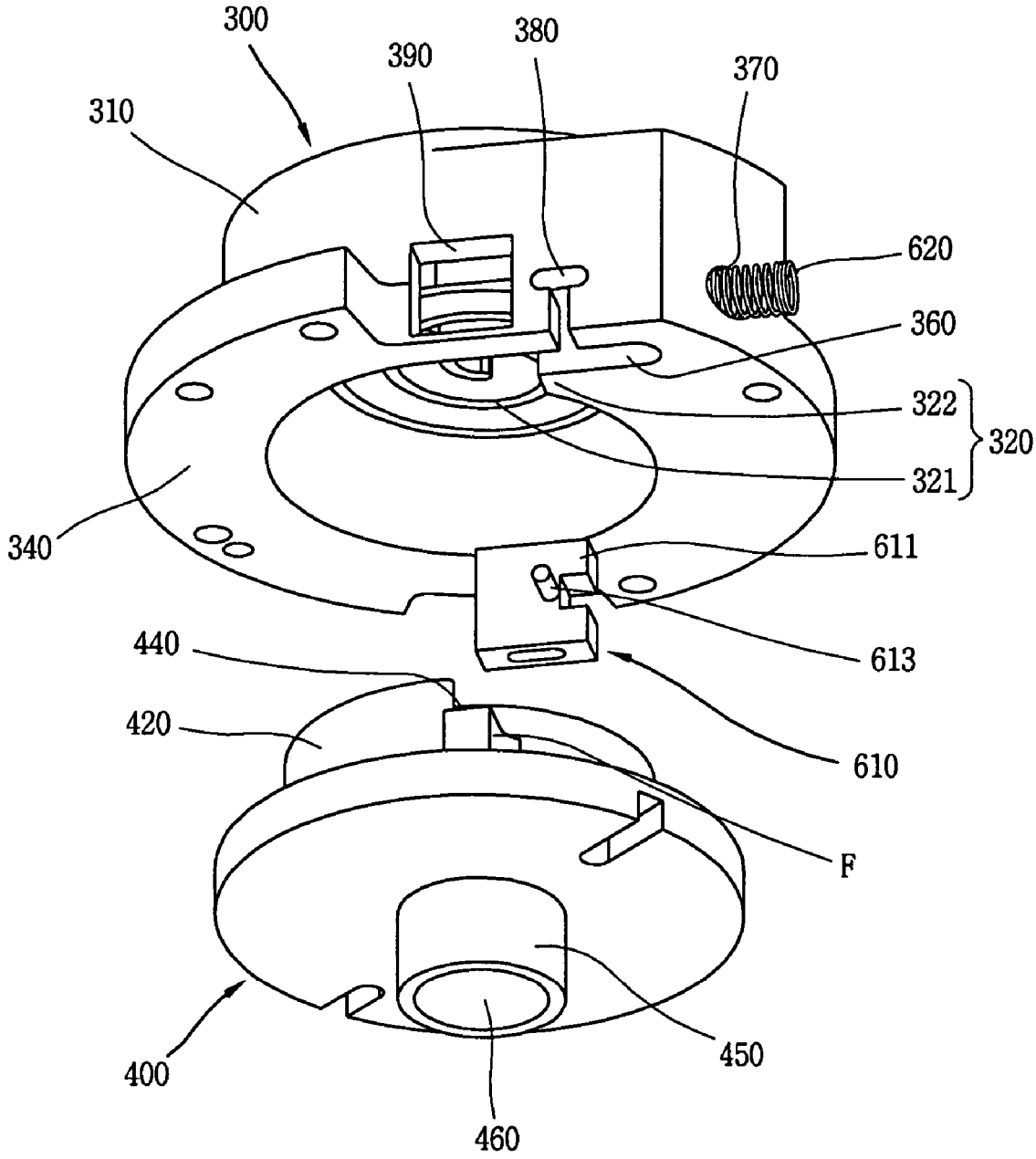

FIGS. 3 and 4 are respectively a frontal section view and a disassembled perspective view showing a compression part of a scroll compressor having a capacity varying apparatus according to one embodiment of the present invention.

The compression part of a scroll compressor will be explained as follows.

In a hermetic container 100 having a certain shape, a main frame 200 and a fixed scroll 300 are mounted with a certain gap from each other. Also, an orbiting scroll 400 is positioned between the fixed scroll 300 and the main frame 200 so as to perform an orbiting motion in engagement with the fixed scroll 300. A rotation shaft 500 coupled to a driving motor is penetratingly inserted into the main frame 200 and is coupled to the orbiting scroll 400.

Figure 5:
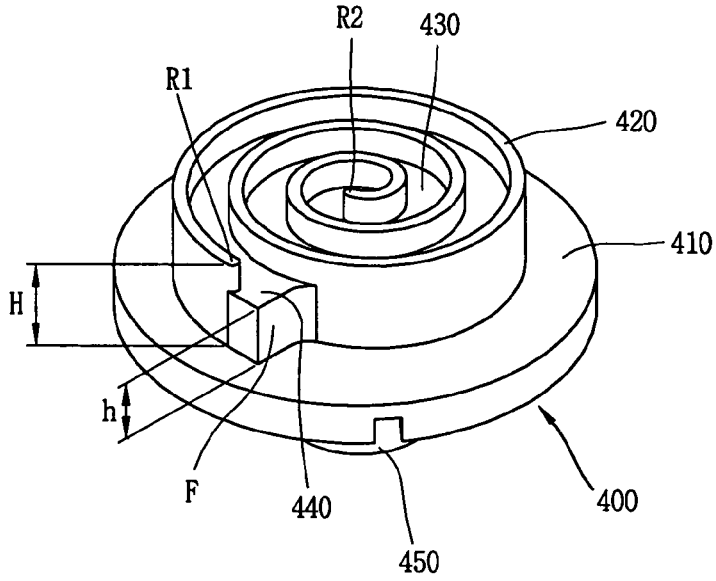
FIG. 5 is a perspective view of an orbiting scroll constituting the compression part of the scroll compressor according to the present invention.

As shown in FIG. 5, in the orbiting scroll 400, a wrap 420 of an involute curve shape having a certain thickness and height is formed at one surface of a disc portion 410 having a certain thickness and area, and a first filling portion 430 having a certain height through an entire region from the outermost end portion R1 to an inner end portion R2 of the wrap 420 is formed. A second filling portion 440 having a certain height towards outside of the wrap 420 is extendingly formed from the first filling portion 430. A boss portion 450 having a certain length is formed at a lower surface of another side of the disc portion 410, and an insertion groove 460 having a certain depth is formed in the boss portion 450. Preferably, the first filling portion 430 and the second filling portion 440 are protruded from one surface of the disc portion 410 with a certain height. A height h of the first filling portion 430 and the second filling portion 440 is lower than a height H of the wrap. The first filling portion 430 is formed throughout the entire region where the wrap 420 is positioned. Also, the second filling portion 440 is extendingly formed at an outer end portion of the wrap 420, and the end surface F is formed as a planar surface. The end surface F of the second filling portion 440 can be formed as a curved surface. The insertion groove 460 is formed up to inside of the first filling portion 430, and an eccentric portion 510 formed at one side of the rotation shaft 500 is inserted into the insertion groove 460.

It is also possible that the first filling portion 430 and the second filling portion 440 are formed as additional components and coupled to each other in the wrap 420.

Figure 6:
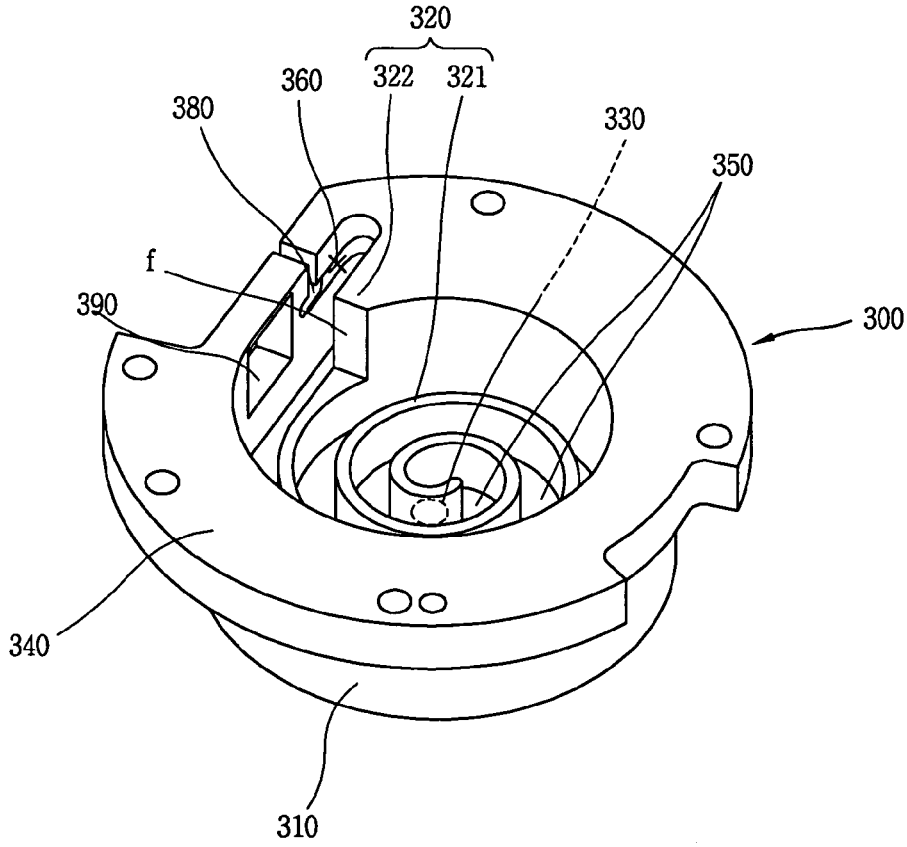
FIGS. 6 and 7 are respectively a perspective view and a frontal view of a fixed scroll constituting the compression part of the scroll compressor according to the present invention.
Figure 7:
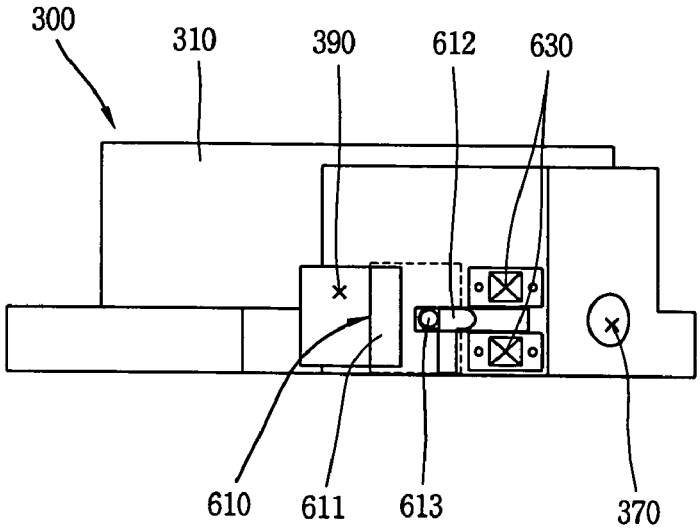

As shown in FIGS. 6 and 7, in the fixed scroll 300, a wrap 320 of an involute curve shape having a certain thickness and height is formed at one surface of a body portion 310 having a certain shape, and a discharge hole 330 is formed at the center of the body portion 310. The wrap 320 is protruded as a spiral groove 350 having a certain depth is formed at a contact surface 340 of the body portion 310 contacting an upper surface of the disc portion 410 of the orbiting scroll.

The wrap 320 of the fixed scroll is composed of a low wrap 321 formed as a region facing the first and second filling portions 430 and 440 of the orbiting scroll is stepped, and a normal wrap 322 having a general height. The step difference between the low wrap 321 and the normal wrap 322 is a height obtained by subtracting the height of the first filling portion 430 or the second filling portion 440 from the wrap height of the orbiting scroll.

The body portion 310 of the fixed scroll is provided with a mounting part. The mounting part is composed of: a sliding groove 360 extendingly formed as a certain shape from the end of the spiral groove 350; a spring inserting hole 370 connected to the sliding groove 360; and a guide hole 380 penetratingly formed at a lateral wall of the sliding groove 360. Both lateral walls of the sliding groove 360 are formed as planar surfaces. The guide hole 380 is formed to have a certain width and length.

A suction hole 390 for sucking gas is formed at a lateral surface of the body portion 310 of the fixed scroll towards inside of the wrap 320. The suction hole 390 is preferably connected to inside of the spiral groove 350, and is formed as a square shape. The guide hole 380 is positioned next to the suction hole 390.

A block assembly 610 of a certain shape is slidably inserted into the sliding groove 360 and the guide hole 380, and a spring 620 for elastically supporting the sliding block assembly 610 is inserted into the spring inserting hole 370. Also, a pulling unit 630 for selectively pulling the sliding block assembly 610 is provided at the body portion 310 of the fixed scroll.

The sliding block assembly 610 includes: a slider 611 formed as a square shape having a certain thickness and inserted into the sliding groove 360; a plunger 612 coupled to the slider 611; and a guide pin 613 coupled to the slider 611 and inserted into the guide hole 380. The plunger 612 is formed to have a certain length. The guide pin 613 is coupled to the slider 611 in a perpendicular state to a wide area of the slider 611.

The spring 620 is preferably is a compression coil spring.

The pulling unit 630 is an electromagnet. The electromagnet is mounted at an outer surface of the body portion 310 of the fixed scroll. The plunger 612 is positioned in the electromagnet with a movable state.

Figure 8:
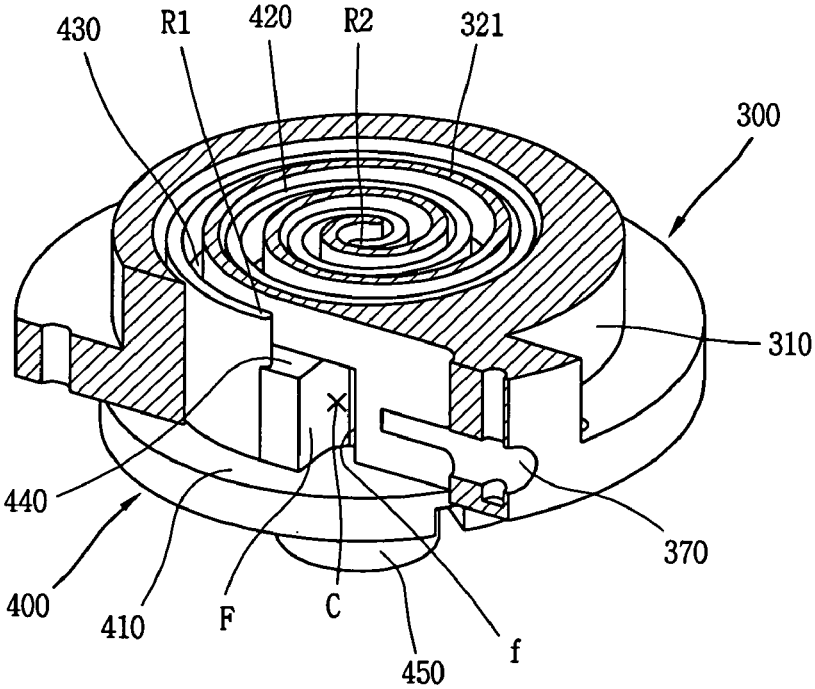
FIGS. 8 and 9 are disassembled perspective views showing a step-type capacity varying apparatus of the scroll compressor according to the present invention.
Figure 9:
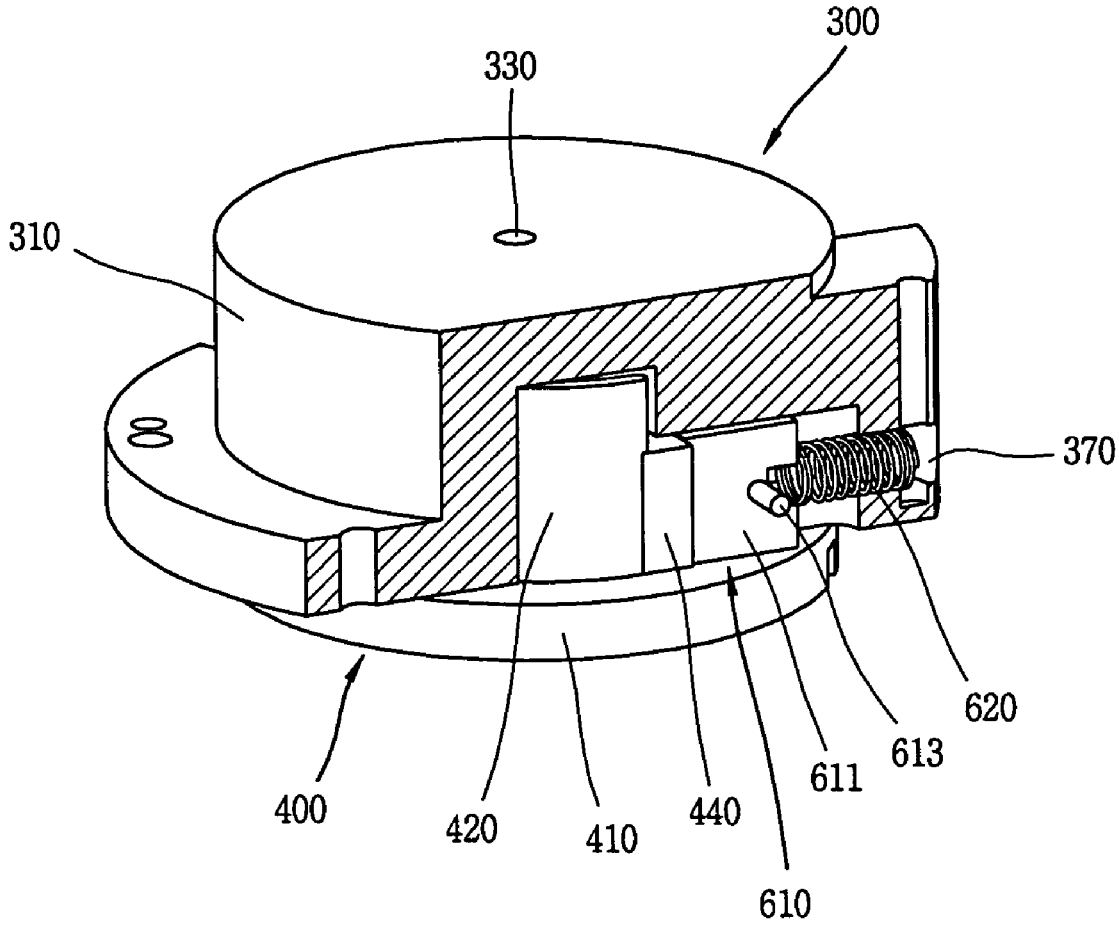

As shown in FIGS. 8 and 9, the wrap 420 of the orbiting scroll 400 is inserted between the main frame 200 and the fixed scroll 300 so as to be engaged with the wrap 320 of the fixed scroll. At this time, the end surface of the low wrap 321 of the fixed scroll is in contact with surfaces of the first filling portion 430 and the second filling portion 440 of the orbiting scroll, and the contact surface 340 of the fixed scroll is in contact with the disc portion 410 of the orbiting scroll. The end surface F of the second filling portion 440 of the orbiting scroll and the stepped surface f of the wrap of the fixed scroll face each other with a certain interval, and the interval forms a passage C. The stepped surface f of the wrap serves as an interface between the low wrap 321 and the normal wrap 322 of the fixed scroll. The slider 611 is elastically supported by the spring 620, so that one side of the slider 611 is in contact with the end surface F of the second filling portion 440. At this time, the electromagnet is not operated. The passage C becomes a blocked state as the slider 611 is in contact with the end surface of the second filling portion 440. Under this state, the slider 611 blocks a part of the suction hole 390.

The mounting part, the sliding block assembly 610, the spring 620, and the pulling unit 630 constitute an opening/closing unit for opening and closing the passage C.

An oldham' ring 700 for preventing a rotation of the orbiting scroll 400 is coupled between the orbiting scroll 400 and the main frame 200, and a discharge valve assembly 800 for opening and closing the discharge hole 330 of the fixed scroll 300 is mounted at an upper surface of the fixed scroll 300.

A suction pipe 120 for sucking gas is coupled to one side of the hermetic container 100, and a discharge pipe 110 for discharging gas is coupled to another side of the hermetic container 100.

A pair of compression pockets formed by the wrap 320 of the fixed scroll and the wrap 420 of the orbiting scroll can be asymmetrical to each other or symmetrical to each other. When the pair of compression pockets are asymmetric to each other, their volumes are different from each other and vice versa.

An unexplained reference numeral 160 denotes a high/low pressure division plate.

Hereinafter, an operation effect of the capacity varying apparatus of a scroll compressor will be explained as follows.

A rotation force of a motor part is transmitted to the rotation shaft 500, and then is transmitted to the orbiting scroll 400 through the eccentric portion 510 of the rotation shaft. The orbiting scroll 400 performs an orbiting motion in an engagement with the fixed scroll 300 centering around the rotation shaft 500.

Figure 10:
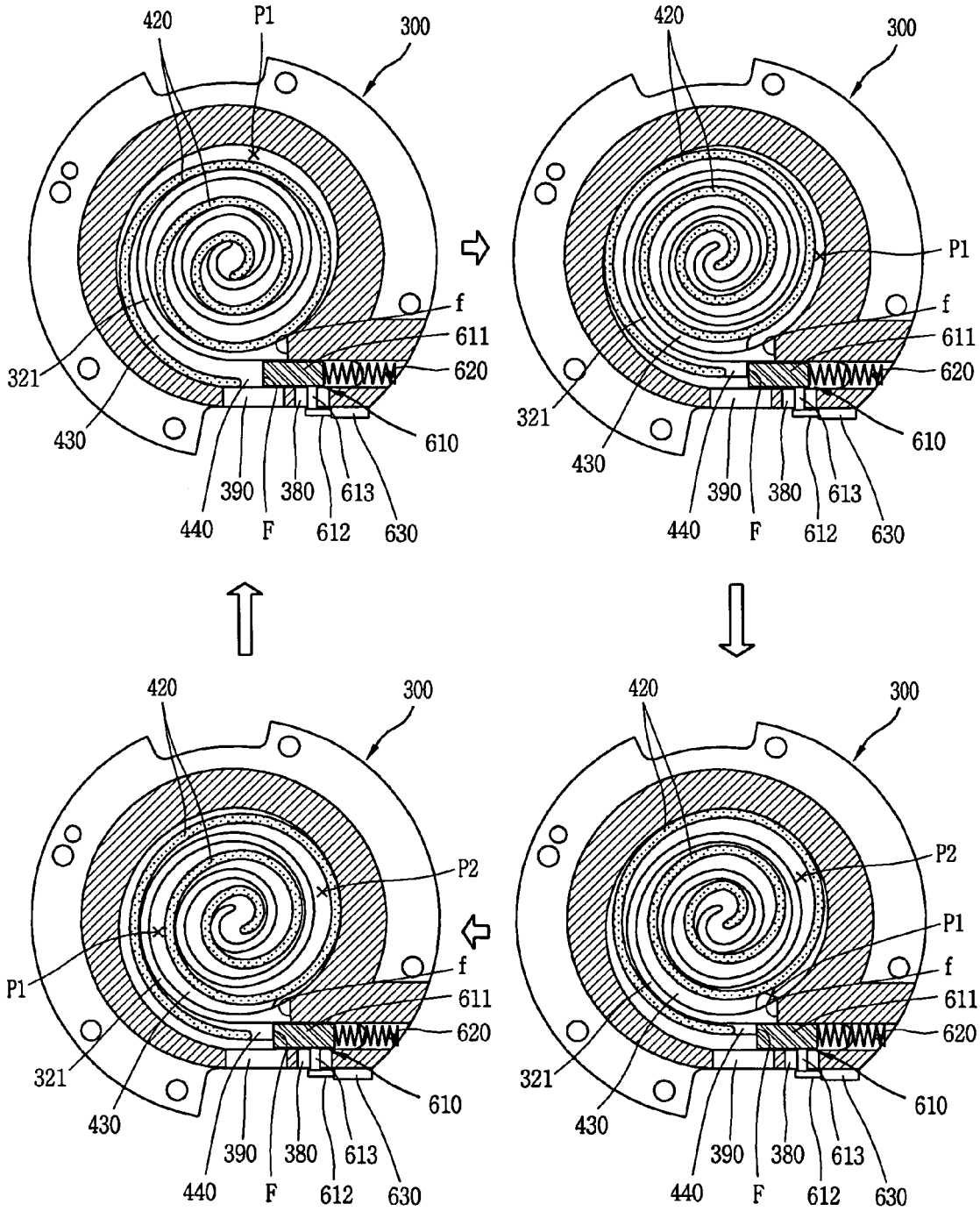
FIGS. 10 and 11 are plane views sequentially showing an operation state of the step-type capacity varying apparatus of the scroll compressor according to the present invention.

In case that the scroll compressor is operated with a capacity of 100%, as shown in FIG. 10, a power is not supplied to the electromagnet, the pulling unit 630. As the electromagnet is not operated, the slider 611 is elastically supported by the spring 620. According to this, the slider 611 is in contact with the end surface F of the second filling portion 440 of the orbiting scroll, thereby blocking the passage C formed by the end surface F of the second filling portion 440 and the stepped surface f of the wrap of the fixed scroll.

Under this state, when the orbiting scroll 400 performs an orbiting motion, the wrap 420 of the orbiting scroll performs an orbiting motion in engagement with the wrap 320 of the fixed scroll. According to this, a first outer compression pocket P1 is formed by the outermost outer wall of the orbiting scroll wrap 420 and an inner wall of the fixed scroll 300 facing the outermost outer wall of the wrap 420, and gas is introduced into the first outer compression pocket P1 through the suction hole 390.

When the orbiting scroll 400 is more orbited, the first outer compression pocket P1 moves to the discharge hole 330 and thereby the volume of the first outer compression pocket P1 is decreased. At the same time, a first inner compression pocket P2 is formed by the outermost inner wall of the orbiting scroll wrap 420 and the outermost outer wall of the fixed scroll wrap 320. Gas is introduced into the first inner compression pocket P2 through the suction hole 390. At this time, the first outer compression pocket P1 is positioned at the first filling portion 430 and the second filling portion 440 of the orbiting scroll thereby to have a great volume change. Also, the first inner compression pocket P2 is positioned at the first filling portion 430 and the second filling portion 440 of the orbiting scroll.

When the orbiting scroll 400 is more orbited, the first outer compression pocket P1 and the first inner compression pocket P2 move to a center portion of the fixed scroll 300 and thereby each volume is changed. Gas compressed in the first outer compression pocket P1 and the first inner compression pocket P2 is discharged to inside of the hermetic container 100 through the discharge hole 330. While the above processes are repeated, gas is compressed. The gas of a high temperature and a high pressure discharged into the hermetic container 100 is discharged to outside through the discharge pipe 120.

As the orbiting scroll 400 performs an orbiting motion in engagement with the fixed scroll 300, the slider 611 inserted into the fixed scroll 300 performs a linear reciprocation at the sliding groove 360 of the fixed scroll in a state of being elastically supported by the spring 620 and comes in contact with the end surface F of the second filling portion 440.

When the first outer compression pocket P1 that has completed a suction process moves to the discharge hole 330 via the first filling portion 430 of the orbiting scroll and the second filling portion 440, the volume of the first outer compression pocket P1 is greatly reduced and thereby a compression ratio is very great.

Figure 11:
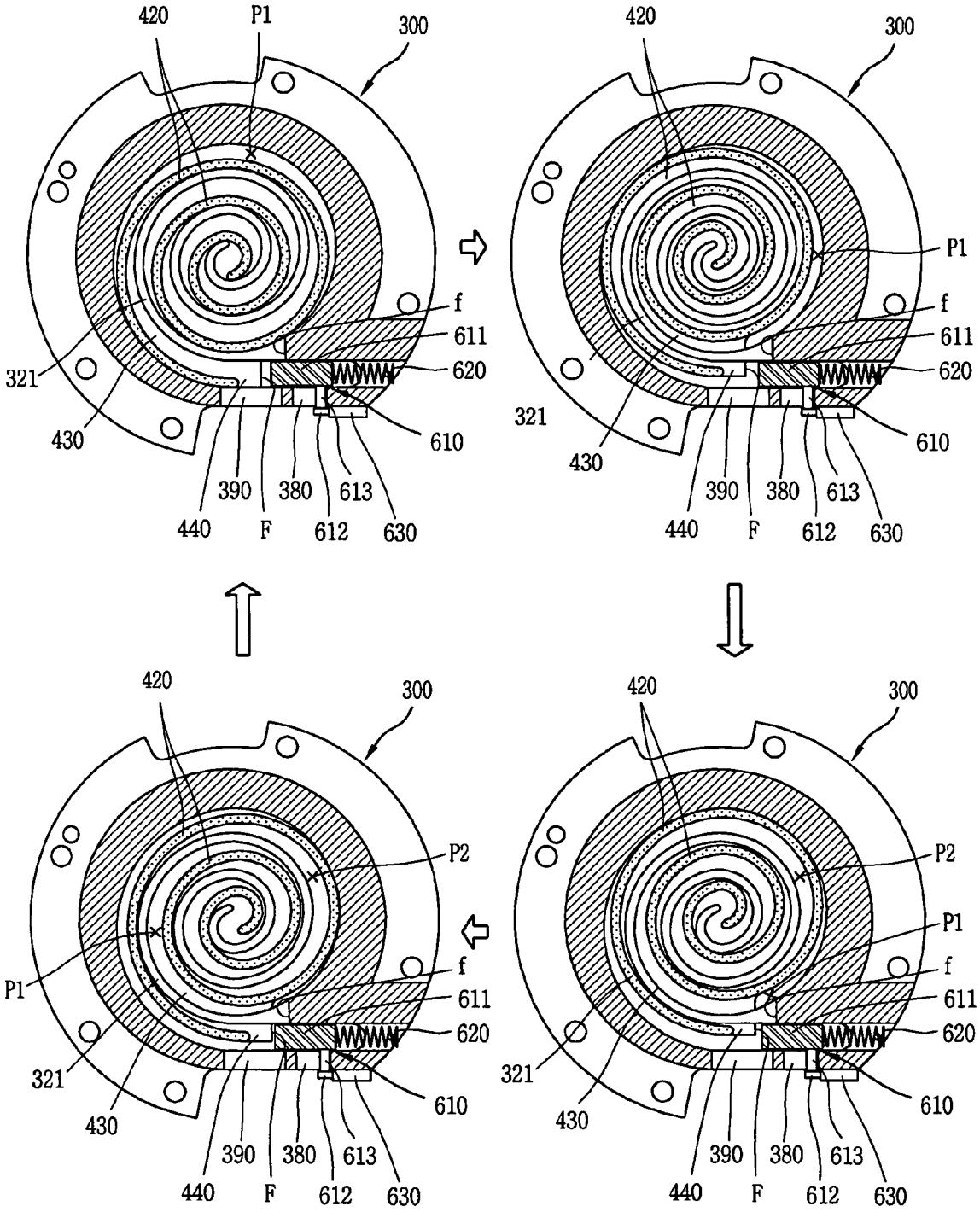

In case that the scroll compressor is operated with a variable capacity, as shown in FIG. 11, a power is supplied to the electromagnet, the pulling unit 630 and the sliding block assembly 610 is pulled by the pulling unit 630. As the pulling unit 630 pulls the sliding block assembly 610, the slider 611 of the sliding block assembly moves to the electromagnet and opens the passage C formed by the end surface F of the second filling portion 440 and the stepped surface f of the wrap of the fixed scroll.

Under this state, when the orbiting scroll 400 performs an orbiting motion, the wrap 420 of the orbiting scroll performs an orbiting motion in engagement with the wrap 320 of the fixed scroll. According to this, the first outer compression pocket P1 is formed by the outermost outer wall of the orbiting scroll wrap 420 and an inner wall of the fixed scroll 300 facing the outermost outer wall of the wrap 420. Gas is introduced into the first outer compression pocket P1 through the suction hole 390. However, since the passage C formed by the end surface F of the second filling portion 440 and the stepped surface f of the wrap of the fixed scroll is opened as the slider 611 moves to the electromagnet, the first outer compression pocket P1 has the same pressure as the suction hole 390.

When the orbiting scroll 400 is more orbited, the first outer compression pocket P1 moves to the discharge hole 330 thereby to have a decreased volume. At the same time, the first inner compression pocket P2 is formed by the outermost inner wall of the orbiting scroll wrap 420 and the outermost outer wall of the fixed scroll wrap 320. Gas is introduced into the first inner compression pocket P2 through the suction hole 390.

The first inner compression pocket P2 is positioned at a part of the first filling portion 430 and the second filling portion 440 of the orbiting scroll.

When the orbiting scroll 400 is more orbited, the first outer compression pocket P1 moves to the discharge hole 330 and a compression process is performed after the first outer compression pocket P1 passes through the passage C. While the first inner compression pocket P2 moves to a center portion of the fixed scroll 300, the volume of the first inner compression pocket P2 is changed and a compression process is performed. Gas compressed while the volumes of the first outer compression pocket P1 and the first inner compression pocket P2 are decreased is discharged into the hermetic container 100 through the discharge hole 330.

As aforementioned, in case that the scroll compressor is operated with a capacity of 100%, the first filling portion 430 is formed throughout the entire inside of the wrap 420 of the orbiting scroll. According to this, the volume of the compression pocket positioned at the suction side is greatly different from the volume of the compression pocket positioned at the first filling portion 430. Also, since gas compressed at the compression pocket is discharged to the discharge hole 330 via the first filling portion 430 and the second filling portion 440, a compression ration is very great.

In case that the scroll compressor is operated with a variable capacity, when the compression pocket is positioned at the suction side, the compression pocket is connected to the suction hole 390 and thereby a compression process is not performed. The compression pocket moves and a compression process is started from the first filling portion 430 and the second filling portion 440, so that a compression ratio is very small.

Also, an operation conversion from a capacity of 100% to a variable capacity can be easily performed by the pulling unit 630.

As another embodiment of the present invention, the first filling portion 430 and the second filling portion 440 can be formed at the fixed scroll 300, and the low wrap 321 corresponding to the first filling portion 430 and the second filling portion 440 can be provided at the wrap 420 of the orbiting scroll.

As aforementioned, in the step-type capacity varying apparatus of a scroll compressor according to the present invention, when the scroll compressor is operated with a capacity of 100%, a compression ratio is very great, and when the scroll compressor is operated with a variable capacity, a compression capacity is small. Therefore, an entire variable capacity width of the scroll compressor is great, thereby reducing a consumption power. Also, since a capacity of the scroll compressor is varied by a mechanical structure, a fabrication cost is more lowered than in a capacity varying structure using a variable speed motor and thereby a price competitiveness is enhanced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A step-type capacity varying apparatus of a scroll compressor, comprising:

an orbiting scroll having a first filling portion step-formed with a constant height from an outer end portion of a wrap to an inner side of the wrap, and a second filling portion extending from the first filling portion outside the outer end portion of the wrap by a certain length;

a fixed scroll engaged with the orbiting scroll with a stepped low wrap, provided on the fixed scroll, corresponding to the first filling portion and the second filling portion of the orbiting scroll, a suction hole for sucking gas being formed in a lateral surface of the fixed scroll; and an opening/closing unit which opens and closes a passage formed by the second filling portion of the orbiting scroll and the stepped low wrap of the fixed scroll, the passage connecting the suction hole with a compression pocket formed by the orbiting scroll and the fixed scroll.

2. The apparatus of claim 1, wherein an end surface of the second filling portion in a longitudinal direction is a planar surface.

3. The apparatus of claim 1, wherein suction hole is formed as a square shape.

4. A step-type capacity varying apparatus of a scroll compressor, comprising:

an orbiting scroll having a first filling portion step-formed with a constant height from an outer end portion of a wrap to an inner side of the wrap, and a second filling portion extending from the first filling portion outside the outer end portion of the wrap by a certain length;

a fixed scroll engaged with the orbiting scroll with a stepped low wrap, provided on the fixed scroll, corresponding to the first filling portion and the second filling portion of the orbiting scroll; and an opening/closing unit which opens and closes a passage formed by the second filling portion of the orbiting scroll and the stepped low wrap of the fixed scroll, wherein the opening/closing unit includes:

a mounting part formed at the fixed scroll;

a sliding block assembly slidably coupled to the mounting part, which opens and closes the passage;

a spring which elastically supports the sliding block assembly; and a pulling unit which selectively pulls the sliding block assembly.

5. The apparatus of claim 4, wherein the pulling unit is an electromagnet.

6. The apparatus of claim 5, wherein the electromagnet is mounted at an outer surface of the fixed scroll.

7. The apparatus of claim 4, wherein the mounting part includes:

a sliding groove formed as a certain shape at the fixed scroll;

a spring inserting hole connected to the sliding groove, in which the spring is inserted; and a guide hole formed at the fixed scroll.

8. The apparatus of claim 4, wherein the sliding block assembly includes:

a slider which opens and closes the passage;

a plunger coupled to the slider and connected to the pulling unit; and a guide pin coupled to the slider.

9. The apparatus of claim 8, wherein the slider is formed as a square shape having a certain thickness.

10. The apparatus of claim 8, wherein the guide pin is coupled to the slider so as to be perpendicular to a wide area of the slider.

* * * * *

UNITED STATES PATENT AND TRADEMARK OFFICE

CERTIFICATE OF CORRECTION

PATENT NO. : 7,316,549 B2
APPLICATION NO. : 11/167150
DATED : January 8, 2008
INVENTOR(S) : Kim et al.

It is certified that error appears in the above-identified patent and that said Letters Patent is hereby corrected as shown below:

At column 8, line 34 (claim 3, line 1) of the printed patent, after the word “wherein”, insert --the--.

Signed and Sealed this

Eighteenth Day of November, 2008

JON W. DUDAS
*Director of the United States Patent and Trademark Office*